US008893882B2

(12) United States Patent
Hicks et al.

(10) Patent No.: US 8,893,882 B2
(45) Date of Patent: Nov. 25, 2014

(54) SYSTEM AND METHOD FOR REDUCING GOLF CLUB CHATTER

(71) Applicants: Mark S. Hicks, Carmel, IN (US); Charles Scott Hicks, Fisher, IN (US)

(72) Inventors: Mark S. Hicks, Carmel, IN (US); Charles Scott Hicks, Fisher, IN (US)

( * ) Notice: Subject to any disclaimer, the term of this patent is extended or adjusted under 35 U.S.C. 154(b) by 135 days.

(21) Appl. No.: 13/621,434

(22) Filed: Sep. 17, 2012

(65) Prior Publication Data

US 2014/0076752 A1 Mar. 20, 2014

(51) Int. Cl.
*A63B 55/00* (2006.01)

(52) U.S. Cl.
CPC ..... *A63B 55/00* (2013.01)
USPC ..... 206/315.6; 206/315.3

(58) Field of Classification Search
CPC ..... A63B 55/00
USPC ..... 206/315.1, 315.6, 315.2, 315.3; 70/62
See application file for complete search history.

(56) References Cited

U.S. PATENT DOCUMENTS

| | | | | | |
|---|---|---|---|---|---|
| 1,599,170 | A | * | 9/1926 | Fatjo | 206/315.6 |
| 1,835,632 | A | | 9/1930 | Buhrke | |
| 1,951,158 | A | * | 3/1934 | Locke et al. | 206/315.5 |
| 4,174,747 | A | * | 11/1979 | Boles | 206/315.6 |
| 5,029,703 | A | | 7/1991 | Dulyea, Sr. | |
| 5,222,596 | A | * | 6/1993 | Jordan | 206/315.6 |
| 5,511,660 | A | | 4/1996 | Yamada et al. | |
| 5,524,753 | A | * | 6/1996 | Murphy | 206/315.6 |
| 5,610,585 | A | * | 3/1997 | Jobe | 340/568.6 |
| 5,816,397 | A | | 10/1998 | Pratt | |
| 5,871,093 | A | | 2/1999 | Sutter | |
| 5,971,146 | A | * | 10/1999 | Jones | 206/315.3 |
| 6,079,558 | A | * | 6/2000 | Yoon | 206/315.3 |
| 6,105,792 | A | | 8/2000 | Chang | |
| 6,112,895 | A | * | 9/2000 | Ryan | 206/315.6 |
| 6,155,418 | A | | 12/2000 | Chang | |
| 6,244,438 | B1 | | 6/2001 | Weinmeier | |
| 6,595,356 | B1 | * | 7/2003 | Homoly | 206/315.3 |
| 6,929,124 | B2 | | 8/2005 | Kawasaki | |
| 7,201,025 | B2 | * | 4/2007 | Mahre et al. | 70/18 |
| 7,434,425 | B2 | * | 10/2008 | Mahre et al. | 70/18 |
| 2001/0017272 | A1 | | 8/2001 | Thompson et al. | |
| 2007/0241009 | A1 | | 10/2007 | Tan | |
| 2008/0011631 | A1 | | 1/2008 | Kim | |

FOREIGN PATENT DOCUMENTS

| | | | |
|---|---|---|---|
| KR | 2002083876 | A | * 11/2002 |
| KR | 20022083876 | A | * 11/2002 |

OTHER PUBLICATIONS

Ogio—No Chatter Golf Bag, printed from website. (http://forum.mygolfspy.com/topic/1587-ogio-no-chatter-golf-bag) Dated Jun. 21, 2010.

* cited by examiner

*Primary Examiner* — Sue A Weaver
(74) *Attorney, Agent, or Firm* — Ice Miller LLP

(57) ABSTRACT

Disclosed herein are systems and methods for securing golf clubs stored in a golf bag so that their tendency to bounce and collide with one another, and thereby produce an undesirable chattering noise, is greatly reduced or eliminated while the golf bag is being carried. The system includes one or more lines or other extended items that make a serpentine path over the top of the golf bag, winding through the golf club shafts. One end of each of the one or more lines is attached to the carrying strap of the golf bag. When the golf bag carrying strap is raised to lift the golf bag off the ground for carrying, tension is placed on the lines and they are caused to retract, securing the clubs against the dividers so that they do not move around and collide with one another as the golf bag is being carried.

19 Claims, 4 Drawing Sheets

SYSTEM AND METHOD FOR REDUCING GOLF CLUB CHATTER

TECHNICAL FIELD OF THE DISCLOSURE

The present disclosure generally relates to golf clubs and, more particularly, to systems and methods for reducing golf club chatter.

BACKGROUND OF THE DISCLOSURE

Typical golf bags sold in the marketplace today have a shape of a cylinder with a single tier design at the top with a very slight angle. The height of these bags are about the length of a sand wedge and the head portion of golf clubs of various lengths stick out of the bag when they are placed in the bag. During transport by a person or golf cart, the clubs move back and forth due to rocking and shaking motions of the bag. Consequently, the clubs tend to hit each other when the bags are transported by a person or golf cart, causing the heads of the similar-sized clubs to strike each other. In addition, the shafts of the longer clubs, such as the driver and the woods, are continually struck by the heads of shorter irons and/or putter. All of this creates a very unwelcome noise commonly referred to as golf club chatter. Also, not only are the heads of all clubs are subject to damage from these constant collisions, but particularly the shafts of taller clubs, which are typically made of graphite materials, are often damaged.

Many golf bags are divided into several compartments to allow clubs to be inserted in a sorted manner. Some dividers are designed to extend all the way down to the bottom of the bag. However, even with such compartments, the heads of neighboring clubs will still collide with one another as the bag is moved, and it is impossible to protect club shafts from being hit by other shorter clubs that are inserted right next to them within the same section or the shorter clubs that are put into one of the neighboring sections. Some bags today have a non-circular shape and a top end designed with many sections with slightly different heights that are somewhat apart from one another to keep the clubs away from each other as much as possible. But, again it is impossible to fully protect the clubs from each other because the physical separation of these sections are not sufficient and the top portions of the club shafts are still exposed well above the top of these golf bags and will repeatedly collide with one another as the bag is moved.

Some bags are made with individual vertical tubes or compartments for each of the clubs. These bags provide better organization and easier club access in and out of the bag. However, the club heads and portions of the club shafts of the longer clubs do stick out of these bags, thus colliding and creating chatter as the bag is moved.

The clubs thus make undesired excessive noises when golf bags are transported by carrying or by golf cart, thus bothering other players when they are trying to concentrate to hit their balls. In addition, the club vibrations while being transported by a golf cart are very severe and shorten the life of clubs. Although golf bags come with a golf bag cover, the clubs move around freely within the golf bag during transportation, especially during traveling, thus causing damage to golf clubs.

SUMMARY OF THE DISCLOSURE

Disclosed herein are systems and methods for securing golf clubs stored in a golf bag so that their tendency to bounce and collide with one another, and thereby produce an undesirable chattering noise, is greatly reduced or eliminated while the golf bag is being carried. The system includes one or more lines or other extended items that make a serpentine path over the top of the golf bag, winding through the golf club shafts. One end of each of the one or more lines is attached to the carrying strap of the golf bag. When the golf bag carrying strap is raised to lift the golf bag off the ground for carrying, tension is placed on the lines and they are caused to retract. This retraction of the lines pulls the golf club shafts snugly against the dividers in the golf bag, securing the clubs against the dividers so that they do not move around and collide with one another as the golf bag is being carried. Setting the golf bag down automatically releases the tension on the lines, thereby releasing the golf clubs and facilitating their extraction from the golf bag for play.

In one embodiment, a system for reducing golf club chatter is disclosed, the system comprising: a golf bag comprising: a golf bag body having a golf bag body front side and a golf bag body rear side opposite the golf bag body front side; a top opening; a first divider disposed in the top opening, thereby defining a plurality of first compartments; and a strap coupled to the golf bag body front side; a first line having a distal first line end and a proximal first line end; wherein the distal first line end is coupled to the golf bag body near the top opening; wherein the proximal first line end is coupled to the strap; and a first golf club disposed in one of the plurality of first compartments, the first golf club further disposed between the first line and the first divider; whereby lifting the strap applies tension to the proximal first line end, causing the first golf club to be cinched against the first divider.

In another embodiment, a system for reducing golf club chatter is disclosed, the system comprising: a golf bag comprising: a golf bag body having a golf bag body front side and a golf bag body rear side opposite the golf bag body front side; a top opening; a first divider disposed in the top opening, thereby defining a plurality of first compartments; and a strap coupled to the golf bag body front side; a first line having a distal first line end and a proximal first line end; wherein the distal first line end is fixed with respect to the golf bag body; wherein the proximal first line end is operably coupled to the strap; and a first golf club disposed in one of the plurality of first compartments, the first golf club further disposed between the first line and the first divider; whereby lifting the strap applies tension to the proximal first line end, causing the first golf club to move toward the first divider.

Other embodiments are also disclosed.

DETAILED DESCRIPTION OF THE VARIOUS EMBODIMENTS

Figure 1:
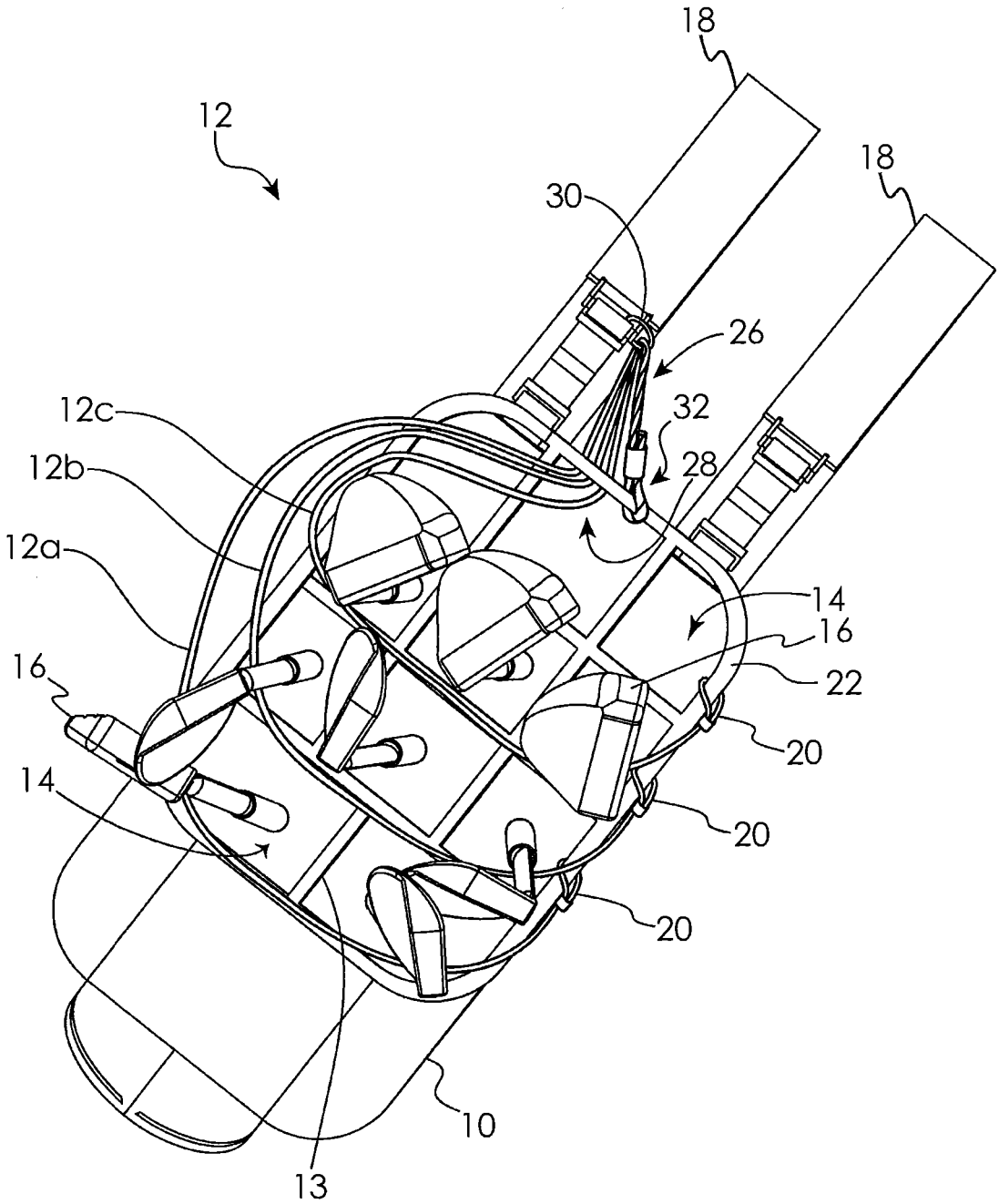
FIG. 1 is a top view of a golf bag incorporating one embodiment system and method to reduce golf club chatter according to the present disclosure.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

The various embodiments disclosed herein prevent the generation of golf club chatter when a golf bag is carried by a player or transported by a golf cart or other conveyance. This is accomplished in the various embodiments by providing one or more lines that have one end anchored to the golf bag and another end anchored to a carrying strap of the golf bag. The one or more lines are arranged such that when the strap of the golf bag is lifted, the one or more lines are pulled taut and thereby cinch the individual golf clubs against the compartment dividers within the golf bag. Thus constrained, the golf clubs are not free to move and collide with one another, thereby eliminating golf club chatter and preventing the golf clubs from becoming damaged.

Referring now to FIG. 1, there is illustrated a golf bag incorporating one embodiment of the lines, indicated generally at 12, that are operable to prevent golf club chatter. The golf bag includes a golf bag body 10 and may include a plurality of dividers 13 to divide the interior of the golf bag 10 into a plurality of compartments 14 into which are placed a plurality of golf clubs 16, as is known in the art. The golf bag 10 includes one or more carrying straps 18 which facilitate transport of the golf bag 10 by placing one or both straps over a player's shoulder(s) in order to support the golf bag 10 while carrying.

The golf bag 10 is equipped with one or more lines 12. For example, in the illustrated embodiment, three lines 12*a*, 12*b*, and 12*c* are provided. Provision of three lines 12*a*, 12*b*, and 12*c* will serve to cinch the golf clubs 16 contained in three rows of compartments 14, as will be explained hereinbelow. A different number of lines 12 are provided in other embodiments. In one embodiment, only a single line 12 is provided and it is wound through all of the golf clubs 16 in order to supply the cinching forces described herein. The lines 12 may be formed from any flexible extended item, such as rope, wire, tubing, fabric, cord, or webbing material, just to name a few non-limiting examples.

As used herein, the terms distal line end and proximal line end are intended to encompass not only the actual terminus of the distal and proximal ends of the line, but also portions of the line that are near the respective distal and proximal termini. With continued reference to FIG. 1, a distal end 20 of each of the lines 12*a*, 12*b*, and 12*c* is secured to the golf bag 10, such as to the top rim 22 of the golf bag 10. In the illustrated embodiment, the distal ends 20 of the lines 12*a*, 12*b*, and 12*c* are secured to the top rim 22 by passing each distal end 20 through a respective hole 24 (see FIG. 2) formed in the top rim 22 and then securing the distal end 20 to its own line 12. In other embodiments, the distal ends 20 are secured to the top rim 22 by other means, the method of attachment not being critical to the present invention. In the illustrated embodiment, the location of attachment of each distal end 20 to the top rim 22 is positioned to the front of the divider 13 against which the golf clubs 16 will be cinched in any row of compartments 14 to be protected by the respective line 12. As will be seen, such placement of the distal end 20 causes the golf clubs 16 to cinch against the rear side of the respective divider when the line 12 is drawn taut.

From the distal end 20, each line 12 runs to the rear of the golf clubs 16 in the row of compartments 14 the line 12 will protect. The proximal end 26 of the line 12 then passes through one or more holes 28 formed through the top rim 22 at the front of the golf bag 10 near the strap 18. In other embodiments, the line 12 is slidably secured to the front of the golf bag 10 by other means, such as by passing through a ring (not shown) attached to the top rim 22. The method used to secure the line 12 at or near the front of the golf bag 10 is not critical, so long as the line 12 is free to slide at the site of securement. In some embodiments, the line 12 is not coupled to the front of the golf bag 10 and is instead coupled directly to the strap 18. The proximal end 26 is then secured so that tension may be applied to the line 12 by movement of one or more of the straps 18. In the illustrated embodiment, each line 12 passes through a ring 30 secured to the strap 18, with the proximal end 26 of each line 12 being anchored to the front of the golf bag 10 at 32. In other embodiments, the proximal end 26 of each line 12 is anchored directly to the strap 18. It will be appreciated that the arrangement of the anchorage of the proximal ends 26 of the lines 12 is not critical to the present invention, so long as the strap(s) 18 is able to apply tension to the lines 12.

Figure 2:
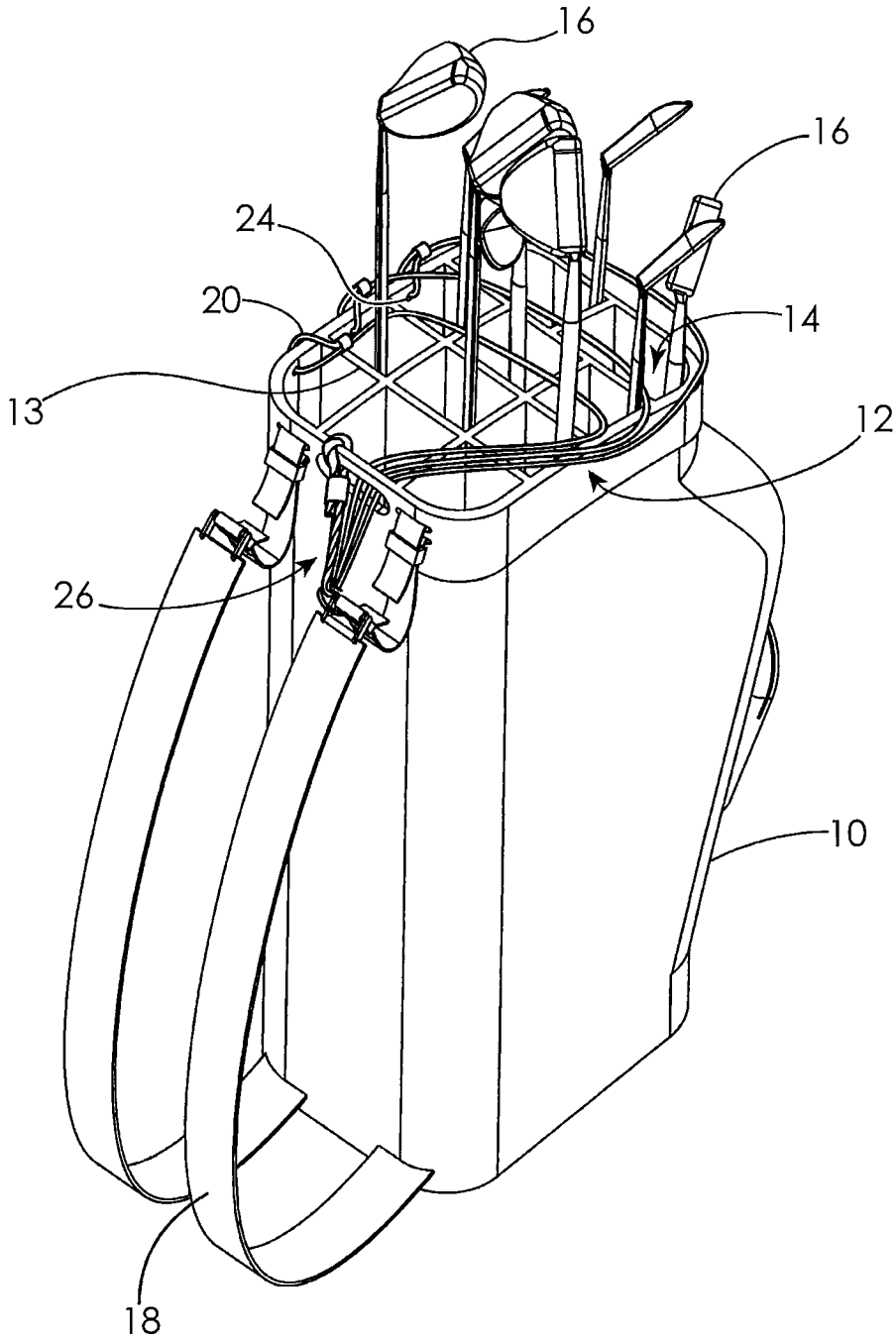
FIG. 2. is a perspective view of the embodiment of FIG. 1 with the lines in a completely slack condition.

With reference now to FIG. 2, the golf bag 10 is illustrated in perspective view. It will be appreciated that each line 12 is anchored to the golf bag 10 at the distal end 20 of the line 12, runs to the rear of the golf clubs 16 in the row of compartments 14 serviced by the line 12, is slidably secured to the front of the top rim 22, and attached to the strap 18. In the illustrated embodiment, three rows of golf clubs 16 are serviced by three lines 12*a*, 12*b*, and 12*c*. In the view of FIG. 2, the strap 18 is in a position, such as when the golf bag 10 is sitting on the ground, where the strap 18 is applying little or no tension to the lines 12 and the lines 12 are slack. In this position, the golf clubs 16 may move relatively freely within their compartments 24, and may easily be extracted from, and returned to, their compartment 24. Thus, it can be seen that the lines 12 do not interfere with use of the golf clubs 16 during play of the game.

Figure 3:
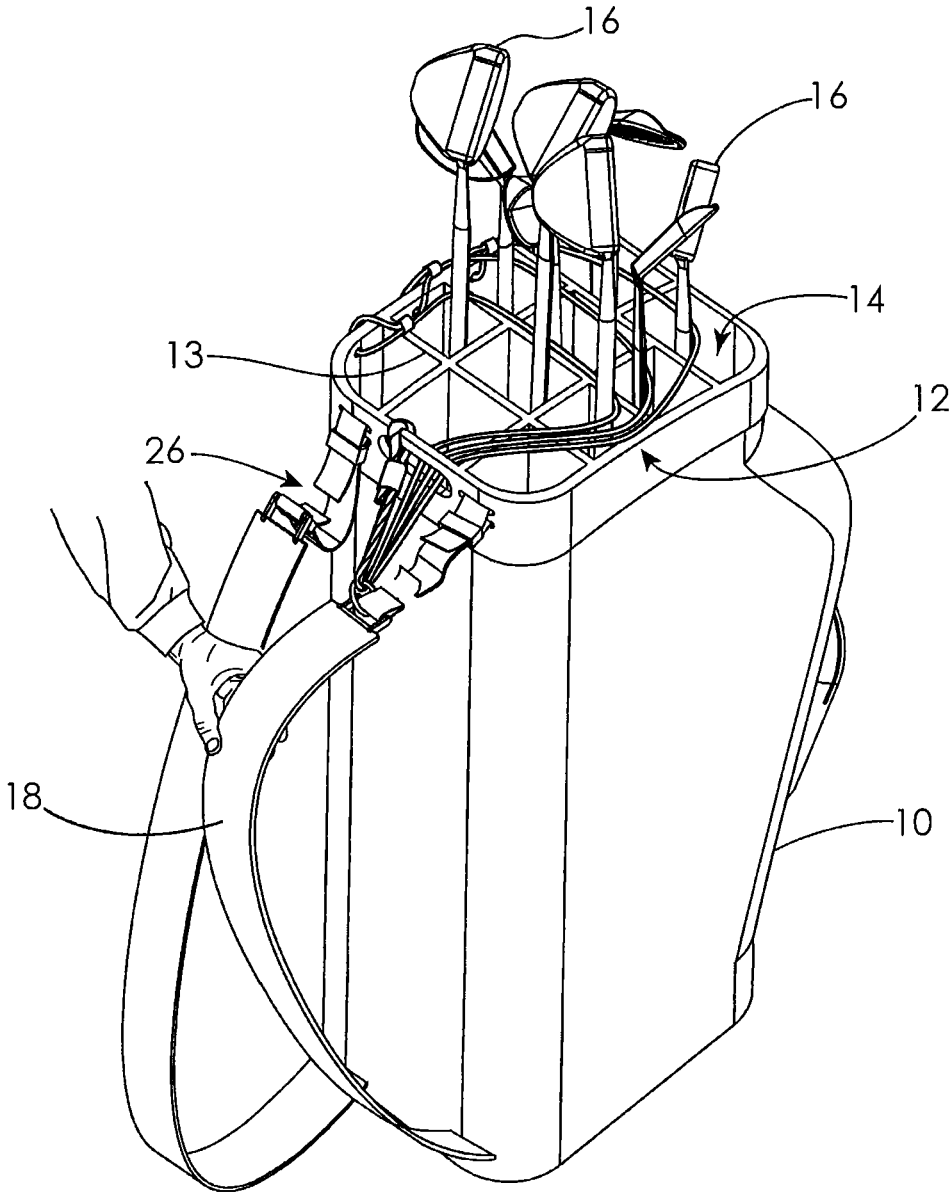
FIG. 3. is a perspective view of the embodiment of FIG. 1 with the lines in a partially slack condition.

Referring now to FIG. 3, the player is getting ready to lift the golf bag 10 and move it, and has grabbed the strap 18 and lifted the strap 18 slightly. Movement of the strap 18 in the upward direction causes it to apply tension to the proximal ends 26 of the lines 12*a*, 12*b*, and 12*c*, causing them to move toward the front of the golf bag 10 (because they are secured to the golf bag 10 at their distal ends 20). As each of the lines 12*a*, 12*b*, and 12*c* moves toward the front of the golf bag 10, it begins to engage individual golf clubs 16 in the row of compartments 14 serviced by the line 12, thereby pushing the golf clubs toward the front of the golf bag 10.

Figure 4:
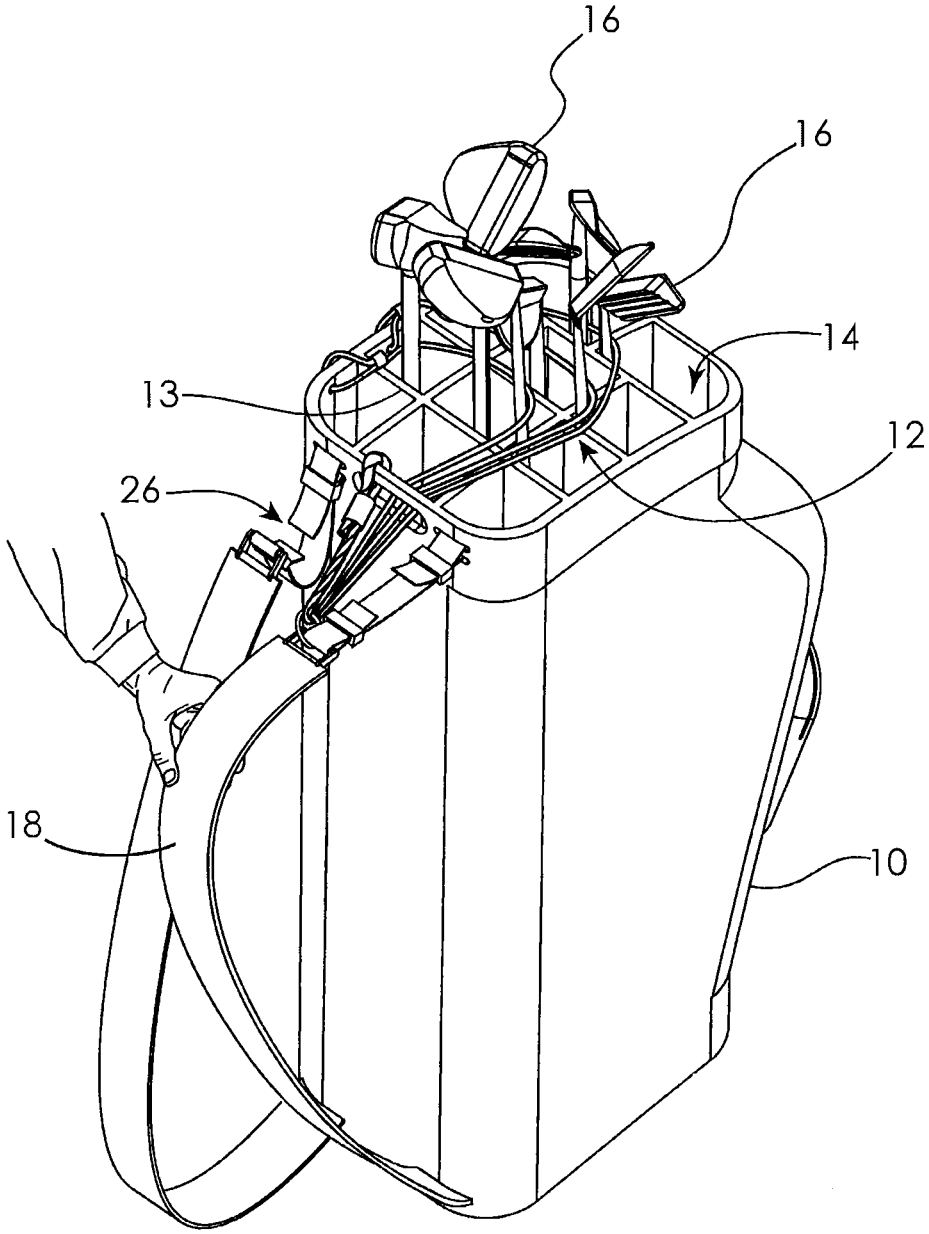
FIG. 4. is a perspective view of the embodiment of FIG. 1 with the lines in a taut condition.

With reference now to FIG. 4, the player has lifted the strap 18 further still and the golf bag 10 is ready to be lifted off of the ground. This motion increases the tension applied to the proximal ends 26 of the lines 12*a*, 12*b*, and 12*c*, causing them to move further toward the front of the golf bag 10. This in turn causes them to push the golf clubs 16 all the way to the respective dividers 13, thereby cinching the golf clubs 16 against the dividers 13. In this position, the golf clubs 16 are not free to move with respect to the dividers 13 or with respect to one another. Therefore, the golf clubs 16 may not collide with one another and produce golf club chatter or damage one another. The player may carry the golf bag 10 to its next destination without worrying about chatter or damage to the golf clubs 16.

Once the player has reached his destination, he may set the golf bag 10 down on the ground and release tension on the strap 18. This will in turn cause the strap 18 to gradually release tension on the lines 12*a*, 12*b*, and 12*c*. The process will work in reverse from the arrangement shown in FIG. 4, to FIG. 3, and then to FIG. 2, where the lines 12*a*, 12*b*, and 12*c* are slack and the golf clubs 16 are no longer cinched against the dividers 13.

It will be appreciated that, because the strap 18 is used as the source of tension applied to the lines 12, the cinching action of the lines 12 occurs automatically every time that the golf bag 10 is lifted off of the ground and carried. Furthermore, the tension, and hence the cinching action, is automatically released when the golf bag 10 is set down since the strap 18 is no longer applying significant tension to the lines 12. In some embodiments, the lines 12 may be caused to cinch the golf clubs even when the golf bag 10 is not being carried, for example while the golf bag 10 is being transported in a golf cart. It will be appreciated that the lines 12 are cinched whenever tension is placed on the strap 18. Therefore, once the golf bag 10 is placed in the golf cart, the strap 18 may be lifted to place tension thereon and then secured in this position. For example, the a mounting surface (not shown) may be provided on the golf bag 10 above the top rim 22 to which the lifted strap 18 may be secured, such as by tying, clipping or any other convenient method. The mounting surface may comprise any physical design, such as a rod, loop, or other structure that extends from the top rim 22 to which the strap 18 may be secured. Alternatively, the strap 18 may be secured to an upper portion of the golf cart, such as the golf cart top or top supports, for example.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected. It is also contemplated that structures and features embodied in the present examples can be altered, rearranged, substituted, deleted, duplicated, combined, or added to each other. The articles "the", "a" and "an" are not necessarily limited to mean only one, but rather are inclusive and open ended so as to include, optionally, multiple such elements.

What is claimed is:

1. A system for reducing golf club chatter, the system comprising:

a golf bag comprising:

a golf bag body having a golf bag body front side and a golf bag body rear side opposite the golf bag body front side;

a top opening;

a first divider disposed in the top opening, thereby defining a plurality of first compartments; and a strap coupled to the golf bag body front side;

a first line having a distal first line end and a proximal first line end;

wherein the distal first line end is coupled to the golf bag body near the top opening;

wherein the proximal first line end is coupled to the strap; and a first golf club disposed in one of the plurality of first compartments, the first golf club further disposed between the first line and the first divider;

whereby lifting the strap applies tension to the proximal first line end, causing the first golf club to be cinched against the first divider.

2. The system of claim 1, wherein the first line is slidably secured to the golf bag between the golf club and the strap.

3. The system of claim 1, wherein the proximal first line end is coupled to the strap and to the golf bag body.

4. The system of claim 3, wherein the proximal first line end is coupled to the strap by passing through a ring coupled to the strap.

5. The system of claim 1, wherein the distal first line end is coupled to the golf bag body by the distal first line end being disposed through a hole in the golf bag body and being attached to itself.

6. The system of claim 1, further comprising:

a second divider disposed in the top opening, thereby defining a plurality of second compartments;

a second line having a distal second line end and a proximal second line end;

wherein the distal second line end is coupled to the golf bag body near the top opening;

wherein the proximal second line end is coupled to the strap;

a second golf club disposed in one of the plurality of second compartments, the second golf club further disposed between the second line and the second divider;

whereby lifting the strap applies tension to the proximal second line end, causing the second golf club to be cinched against the second divider;

a third divider disposed in the top opening, thereby defining a plurality of third compartments;

a third line having a distal third line end and a proximal third line end;

wherein the distal third line end is coupled to the golf bag body near the top opening;

wherein the proximal third line end is coupled to the strap; and a third golf club disposed in one of the plurality of third compartments, the third golf club further disposed between the third line and the third divider;

whereby lifting the strap applies tension to the proximal third line end, causing the third golf club to be cinched against the third divider.

7. The system of claim 1, wherein the first line comprises a material selected from the group consisting of: rope, wire, tubing, fabric, cord, and webbing material.

8. The system of claim 1, wherein the distal first line end is coupled to the golf bag body near the top opening at a location between the first divider and the golf bag body front side.

9. A system for reducing golf club chatter, the system comprising:

a golf bag comprising:

a golf bag body having a golf bag body front side and a golf bag body rear side opposite the golf bag body front side;

a top opening;

a first divider disposed in the top opening, thereby defining a plurality of first compartments; and a strap coupled to the golf bag body front side;

a first line having a distal first line end and a proximal first line end;

wherein the distal first line end is fixed with respect to the golf bag body;

wherein the proximal first line end is operably coupled to the strap; and a first golf club disposed in one of the plurality of first compartments, the first golf club further disposed between the first line and the first divider;

whereby lifting the strap applies tension to the proximal first line end, causing the first golf club to move toward the first divider.

10. The system of claim 9, wherein the distal first line end is coupled to the golf bag body.

11. The system of claim 10, wherein the distal first line end is coupled to the golf bag body by the distal first line end being disposed through a hole in the golf bag body and being attached to itself.

12. The system of claim 10, wherein the distal first line end is coupled to the golf bag body near the top opening.

13. The system of claim 12, wherein the distal first line end is coupled to the golf bag body near the top opening at a location between the first divider and the golf bag body front side.

14. The system of claim 9, whereby lifting the strap applies tension to the proximal first line end, causing the first golf club to be cinched against the first divider.

15. The system of claim 9, wherein the first line is slidably secured to the golf bag between the golf club and the strap.

16. The system of claim 9, wherein the proximal first line end is coupled to the strap and to the golf bag body.

17. The system of claim 16, wherein the proximal first line end is coupled to the strap by passing through a ring coupled to the strap.

18. The system of claim 9, further comprising:

a second divider disposed in the top opening, thereby defining a plurality of second compartments;

a second line having a distal second line end and a proximal second line end;

wherein the distal second line end is fixed with respect to the golf bag body;

wherein the proximal second line end is operably coupled to the strap;

a second golf club disposed in one of the plurality of second compartments, the second golf club further disposed between the second line and the second divider;

whereby lifting the strap applies tension to the proximal second line end, causing the second golf club to move toward the second divider;

a third divider disposed in the top opening, thereby defining a plurality of third compartments;

a third line having a distal third line end and a proximal third line end;

wherein the distal third line end is fixed with respect to the golf bag body;

wherein the proximal third line end is operably coupled to the strap; and a third golf club disposed in one of the plurality of third compartments, the third golf club further disposed between the third line and the third divider;

whereby lifting the strap applies tension to the proximal third line end, causing the third golf club to move toward the third divider.

19. The system of claim 9, wherein the first line comprises a material selected from the group consisting of: rope, wire, tubing, fabric, cord, and webbing material.

* * * * *